United States Patent [19]

Kuhn et al.

[11] 4,073,479

[45] Feb. 14, 1978

[54] SULFIDIZATION REACTION

[75] Inventors: Martin C. Kuhn; John A. Stephens; Michael J. Noakes, all of Tucson, Ariz.; Allen D. Rovig, Butte, Mont.

[73] Assignee: The Anaconda Company, Tucson, Ariz.

[21] Appl. No.: 727,648

[22] Filed: Sept. 29, 1976

Related U.S. Application Data

[62] Division of Ser. No. 506,570, Sept. 16, 1974.

[51] Int. Cl.[2] ..... F27B 7/14

[52] U.S. Cl. ..... 266/173

[58] Field of Search ..... 266/145, 173, 213; 259/3, 9, 10, 25, 26, 45, 46, 84, 85, 109, 110

[56] References Cited

U.S. PATENT DOCUMENTS

| | | | |
|---|---|---|---|
| 3,090,602 | 5/1963 | Benton | 259/3 |
| 3,090,606 | 5/1963 | Burnet | 259/109 |
| 3,247,021 | 4/1966 | Steele et al. | 259/9 |
| 3,291,460 | 12/1966 | Andrae | 259/109 |
| 3,820,960 | 6/1974 | Platz et al. | 259/108 |

*Primary Examiner*—Gerald A. Dost

[57] ABSTRACT

The process of sulfidizing an acid copper leach pulp prior to flotation recovery of the copper therein comprising adding to and admixing with said pulp in a reaction zone an ionizable sulfide material, said sulfide material being added in an amount proportional to the amount of copper passing through said zone so that the sulfidization reaction is completed within about 30 seconds and the pulp leaving said zone has an aqueous copper concentration of from about 0.014 to 0.024 gram per liter and a reactor for such process comprising elongated tubular means, shaft means mounted in said tubular means, and a plurality of blade members attached to said shaft, said blade members being spaced along said shaft at approximately 30° pitch angles relative to the axial direction of the shaft and there being a reverse pitch direction of certain of said blades at predetermined distances along the length of said shaft.

5 Claims, 4 Drawing Figures

SULFIDIZATION REACTION

This is a division of application Ser. No. 506,570 filed Sept. 16, 1974.

BACKGROUND OF THE INVENTION

Sulfidization is used in conditioning a flotation pulp and comprises addition of soluble, and usually alkaline, sulfides to an aqueous pulp, such as a leach pulp, to produce a sulfidemetal layer on an oxidized ore surface. The ore can then be floated as if it were a sulfide ore. While highly successful in the processing of some ores, such as lead ores, sulfidization has been of limited utility in connection with copper ores.

Copper pulps contain significant amounts of pyrites and complete copper sulfidization results in excessive activation of these pyrites. While such activation does not adversely affect the rougher flotation of the copper, it does make pyrite rejection in the subsequent cleaner flotation extremely difficult. This is due to the fact that the activation of the pyrites results in deposition of elemental sulfur at the pyrite surface and this sulfur layer results in a naturally hydrophobic surface that is resistant to normal pyrite depression techniques during cleaner flotation. Attempts to overcome this problem by severe pyrite depression environments have not been successful since they result in very poor copper recovery in the cleaner flotation circuit.

In efforts to overcome such unsatisfactory flotation and copper loss, incomplete sulfidization of the copper has been tried. However, this is equally unsuitable since insufficient sulfidization results in inadequate sulfide conditioning of the copper thereby preventing optimum rougher flotation recovery and consequent copper loss.

Thus, with copper pulps it has not been possible heretofore to optimize copper flotation recovery while minimizing pyrite activation and copper loss when sulfidizaton is used.

SUMMARY OF THE INVENTION

The instant invention enables the optimum sulfide activation of the copper without overactivation of the pyrite thereby avoiding undue copper loss and cleaning difficulties during cleaner flotation.

Briefly stated, the present invention comprises the process of sulfidizing an acid copper leach pulp prior to flotation recovery of the copper therefrom comprising adding to and intimately admixing with said pulp in a reaction zone an ionizable sulfide material, said sulfide material being added in an amount proportional to the amount of copper passing through said zone so that the sulfidization reaction is completed within about 30 seconds and the pulp leaving said zone has an aqueous copper concentration of from about 0.014 to 0.024 gram per liter.

The invention also comprises a reactor for such process comprising elongated tubular means, shaft means mounted in said tubular means, and a plurality of blade members attached to said shaft at approximately 30° pitch angles relative to the axial direction of the shaft, there being a reverse pitch direction of certain of said blade members at predetermined distances along the length of said shaft.

DETAILED DESCRIPTION

Figure 1:
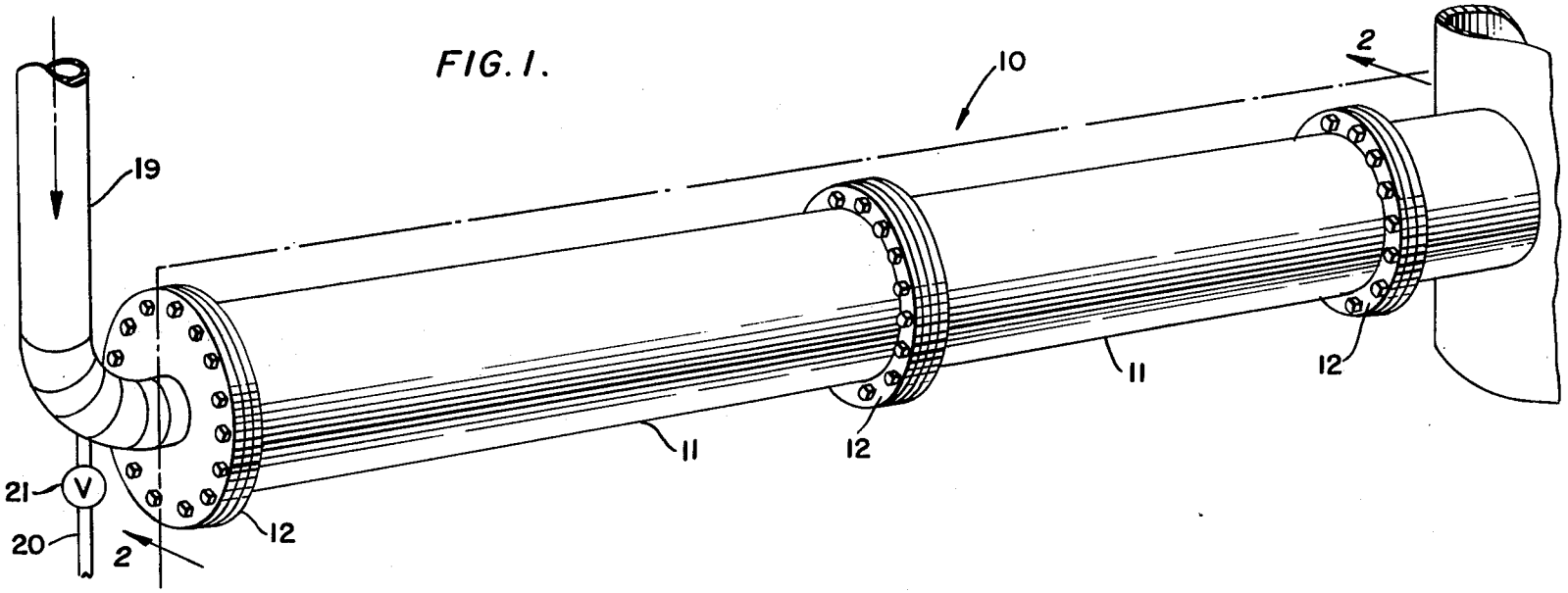
FIG. 1 is a perspective view of a reactor in accordance with the present invention.
Figure 2:
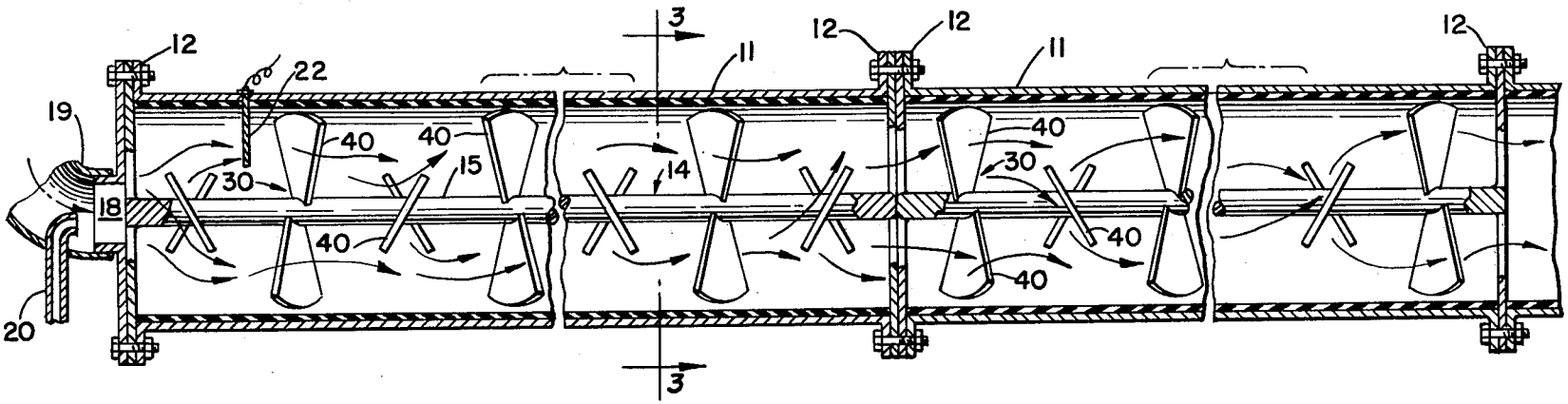
FIG. 2 is a sectional view taken along line 2—2 of FIG. 1.
Figure 3:
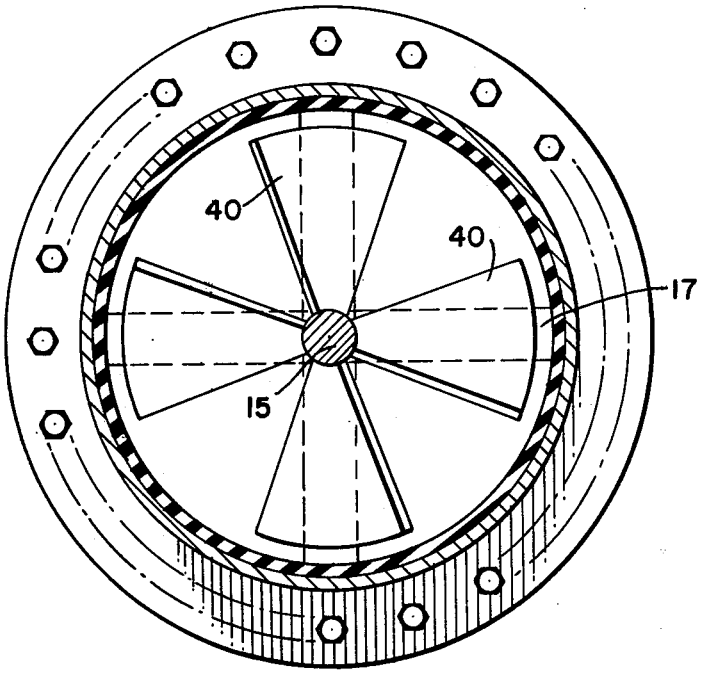
FIG. 3 is a sectional view taken along line 3—3 of FIG. 2.

The method of preparing the acid copper leach pulp and rougher and cleaner flotation steps do not form any part of the instant invention.

With respect to the copper pulp to be sulfidized, it can be any obtained by the known acid leaches of copper ores or concentrates, such as the conventional $H_2SO_4$ leach systems which are preferred. The copper concentration in the pulp is not critical in that the instant process, as is described below, is operative with all levels of copper in the pulp. In like manner, after sulfidization in accordance with the present invention, the sulfidized pulp can be floated by any of the conventional rougher and cleaner flotation procedures utilizing, if desired, the standard pyrite depressing techniques.

What is critical is the control of the degree of sulfidization and the sulfidization reaction time. These permit the optimum recovery of copper.

As to the degree of sulfidization, it has been found that complete sulfidization of the copper should not be effected, but that it is essential to terminate the reaction at a point where there is in the reacted pulp a residual aqueous copper level of about 0.014 to 0.024 gram per liter (gpl). Levels of copper below or above this range do not give the results desired. The sulfide is added at a rate proportional to the physical amount of copper in the pulp then passing through the reaction zone in an incremental time.

It is also necessary that the sulfidization reaction be carried out in about 30 seconds or less. It has been found that the bulk of dissolved copper in the pulp is precipitated very rapidly, regardless of initial solution strength, down to about 0.08 gpl copper. From such level to the range required in the instant process, the sulfidization reaction is slower due to the need for increased diffusion of the sulfide used. However, vigorous agitation and constant monitoring of the pulp insure that adequate sulfide is added and the reaction completed to the point desired within 30seconds. This short reaction time permits continuous sulfidization of the pulp and, if a gaseous sulfide such as $H_2S$ is used, prevents the detrimental effects of sulfidization if an excess amount of $H_2S$ is inadvertently added to the pulp. The pulp must be exposed to $H_2S$ for a period of at least three minutes before excess activation of the pyrites can be effected. Therefore, it an excess amount of $H_2S$ is inadvertently added to the pulp in the instant process, it will escape from the sulfidization zone to the atmosphere once the pulp is removed from such zone, before it has had sufficient time to activate the pyrites.

With respect to the ionizable sulfide used, it can be a solid, liquid, or a gas, but it is preferred to utilize gaseous $H_2S$. Examples of other suitable sulfides are aqueous solutions of soluble alkaline sulfides heretofore used for sulfidizaton.

The sulfidization reaction can be carried out in any suitable vessel capable of containing the amount of pulp desired for the maximum 30 seconds or so reaction time, but it is preferred to use a tube or pipe of suitable diameter having at least one valve-controlled opening therein for addition of the sulfide to the pulp as described below. The proper amount of sulfide to be added will vary as the amount of copper in the pulp varies, but can be readily determined by any one of several methods discussed below. As discussed below, the valve is preferably automatically controlled to deliver the sulfide, such as $H_2S$ gas, at a rate proportional to the physical amount of copper in the pulp passing through the reactor. The means for determining the amount of sulfide it is necessary to add are connected by conventional electrical and mechanical means to the valve admitting the sulfide so as to cause it to automatically supply the necessary amount of sulfide.

The residual copper levels can be constantly monitored by a specific copper ion electrode or by the use of an atomic absorption unit (both known methods) or the solution potential or EMF can be constantly measured. The last noted precedure is preferred since it has been found that maintaining the EMF in the range of about +100 to +150 mv will result in residual copper levels within the essential range. In fact, maintaining the EMF of the pulp solution above 0 mv, and preferably above +50 mv, will prevent any undue pyrite activation since EMF values of −100 mv represent gassing with $H_2S$ for three minutes which would result in pyrite over-activation and difficulties in the cleaner flotation cycle.

The sulfide is preferably added continuously to the stream of copper pulp entering the reaction zone with constant agitation of the mixture. This enables the most rapid sulfidization and avoids any localized pockets of pulp having a copper concentration below about 0.014 gpl and consequent excess activation of the pyrites. The agitation is accomplished by having baffles in the pipe so spaced as to repeatedly reverse the transverse direction of pulp flow relative to the pipe walls. This permits active mixing and streamlined flow of the pulp and avoids any turbulence which would lead to localized oversulfidization of the pulp. As to temperature of reaction, the sulfidization is carried out at ambient temperature.

Referring to the drawings, there is shown a reactor 10 comprising elongated tubular means 11, preferably lined pipes as hereinafter described, having flanges 12 at each end and containing mixing means 13 therein.

Mixing means 13 comprise shaft means 14 consisting of elongated pipe 15 terminating at their ends with conventional type flange rings 16 and support struts 17 which are affixed to the pipe 15 as by welding. Flange rings 16 have openings therein and are of a size such as to mate with the flanges 12 on the elongated tubular means. Thus, the shaft means may be inserted into the tubular end and flanges 12 and 16 on both elements bolted together to mount the shaft means 14, preferably centrally, in tubular means 11.

The inlet end 18 of tubular means 11 is connected to pulp conveying means 19. Connected to such pulp conveying means is gas line 20 which is used to convey the gas to be admixed with the pulp just as these two reactants are being inserted into the reactor 10. The flow of gas to the pulp is controlled by means of valve 21, which valve 21 is, in turn, automatically controlled by conventional control means and electrical circuitry (not shown) to vary the amount of gas delivered so that it will be at a rate proportional to the physical amount of copper in the pulp being passed to the reactor as described above. Probe means 22 are a part of the conventional control means and constantly measure the solution potential of the slurry in the reactor 10 and are connected by conventional electrical means (not shown) to valve 21 to control the amount $H_2S$ gas added as has previously been discussed.

Figure 4:
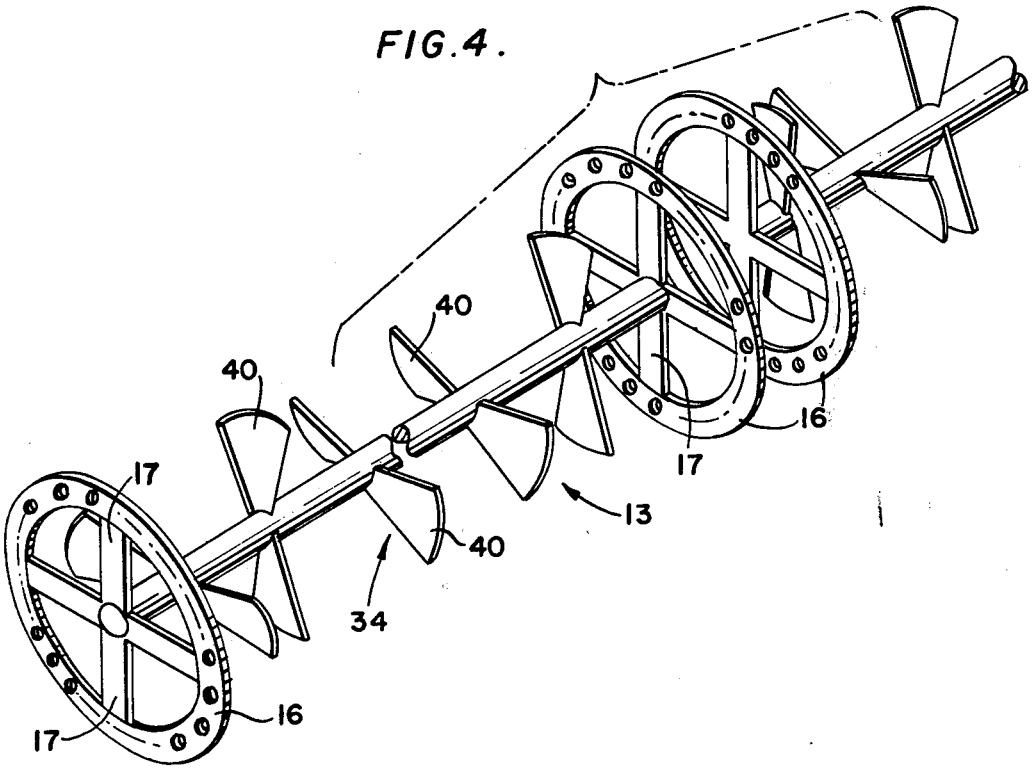
FIG. 4 is a fragmented partial perspective view of the shaft means and attached blade means.

Attached to shaft 15 as by welding are a plurality of paired blade or baffle members 30 which are at an approximately 30° pitch angle relative to the axial direction of shaft 15. As best shown in FIG. 4, blade members 30 have respective ones of the pitched blades 40 diametrically opposed to the other. Also, each adjacent set of blade members 30 are mounted so as to be displaced at right angles to each other. In addition, every alternate pair of blade members 30 in the same axial position on shaft 15 is in a reverse pitch direction (still at approximately 30°).

This structure insures the proper admixture of the gas and pulp to insure not only the rapid reaction necessary, but also to prevent either under-reaction or over-reaction. The location also of the blades 40 acts to rapidly reverse transverse direction of the pulp flow relative to the pipe walls, thus permitting active mixing and streamlined flow of the pulp without any turbulence.

As used herein, the term "pitch angle" refers to the angle of each blade 40 from a horizontal plane perpendicular to the longitudinal axis of shaft 15.

It is preferred that all interior elements of the reactor be coated with a material resistant to the gas, sulfide material, and reaction conditions. A rubber coating or other suitable resistant material such as the plastics Neoprene and nylon can be used for this purpose.

While the invention has been described in connection with a preferred embodiment, it is not intended to limit the invention to the particular form set forth, but, on the contrary, it is intended to cover such alternatives, modificatons and equivalents as may be included within the spirit and scope of the invention as defined by the appended claims.

What is claimed is:

1. A reactor comprising elongated tubular means, shaft means mounted in said tubular means, and a plurality of paired blade members attached to said shaft and radially extending therefrom at spaced intervals therealong at approximately 30° pitch angles relative to the axial direction of the shaft, there being a reverse pitch direction of alternate pairs of said paired blade members extending in the same radial direction.

2. The reactor of claim 1 wherein each one of the said paired blade members having respective ones of the pitched blade members diametrically opposed to the other and wherein adjoining pairs of blade members are spaced at about 20° from each other about the circumference of said shaft.

3. The reactor of claim 2 wherein the elongated tubular means is a pipe coated with a material substantially resistant to the reactants and reaction conditions in the reactor and the shaft means is generally centrally located in said pipe.

4. A reactor apparatus for use in sulfidizing an acidified copper leach pulp comprising an elongated tubular means having inlet means connected thereto, said inlet means enabling introduction of the pulp into said tubular means, shaft means mounted in said tubular means, a plurality of paired blade members attached to said shaft and radially extending therefrom at spaced intervals therealong at preselected pitch angles relative to the axial direction of said shaft, there being a reverse pitch direction of alternate pairs of said paired blade members extending in the same radial direction, means for introducing a gaseous reactant to the pulp in said inlet means such that the proportional amounts of the gaseous reactant is admixed with the pulp prior to entry into said tubular means, and means for probing the admixed pulp and gaseous reactants, and for enabling preselected proportional control of the gaseous reactants added by said introducing means.

5. The apparatus set forth in claim 4 wherein said paired blade members have 30° pitch angles relative to the axial direction of the shaft, said paired blade members having respective ones of the pitched blade members diametrically opposed to the other and wherein adjoining pairs of blade members are spaced at about 90° from each other about the circumference of said shaft, and said elongated tubular means is a pipe coated with a material substantially resistant to the reactants and reaction conditions in the reactor and the shaft means is generally centrally located in said pipe.

* * * * *

UNITED STATES PATENT AND TRADEMARK OFFICE

CERTIFICATE OF CORRECTION

PATENT NO. : 4,073,479

DATED : February 14, 1978

INVENTOR(S) : Martin C. Kuhn et al

It is certified that error appears in the above-identified patent and that said Letters Patent are hereby corrected as shown below:

Front piece - PENNIE & EDMONDS is not recited

Column 1, lines 38, 39, "sulfidizaton" should read -sulfidization--

Column 4, line 50, "20°" should read --90°--

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*